United States Patent [19]

Pereira

[11] Patent Number: 4,951,331

[45] Date of Patent: Aug. 28, 1990

[54] CRIB MATTRESS PATTING DEVICE

[76] Inventor: Fred A. Pereira, 222 Kukuau St., Hilo, Hi. 96720

[21] Appl. No.: 464,316

[22] Filed: Jan. 12, 1990

[51] Int. Cl.[5] ..... A47D 9/02

[52] U.S. Cl. ..... 5/109; 5/508; 128/33

[58] Field of Search ..... 5/108, 109, 508; 128/33; 182/182, 105

[56] References Cited

U.S. PATENT DOCUMENTS

| | | | |
|---|---|---|---|
| 2,072,791 | 3/1937 | Bare | 5/508 |
| 2,765,478 | 10/1956 | Pinto | 5/109 |
| 3,019,789 | 2/1962 | Krauss | 128/33 |
| 3,022,520 | 2/1962 | Finger | 5/109 |
| 3,139,630 | 7/1964 | Hunt | 5/109 |
| 3,225,365 | 12/1965 | Miller | 5/109 |
| 3,311,935 | 4/1967 | Petty | 5/109 |
| 3,653,080 | 4/1972 | Hafele | 5/108 |
| 3,851,343 | 12/1974 | Kinslow | 5/109 |
| 3,882,556 | 5/1975 | Accurso | 5/109 |
| 4,231,126 | 11/1980 | Hurkett | 5/108 |
| 4,667,358 | 5/1987 | Penterman | 5/508 |
| 4,681,096 | 7/1987 | Cuervo | 128/33 |

*Primary Examiner*—Michael F. Trettel
*Assistant Examiner*—Flemming Saether
*Attorney, Agent, or Firm*—Henderson & Sturm

[57] ABSTRACT

A device for imparting a pat to the underside of an infant crib for helping to soothe or induce sleep in a baby or child. The device includes a frame which sits on the floor beneath the crib. The frame includes a reciprocating means which is attached to the frame and a "T" bar structure which has a horizontal member with two ends that have apertures therein and a vertical member attached to the horizontal member midway between the two ends. A pair of elongated vertical rods are adjustably attached to each end of the horizontal member by wing nuts. Attached to the top of the vertical rod is a resilient cup-like structure that contacts the underside of mattress when the device is electrically connected to a power source.

7 Claims, 2 Drawing Sheets

CRIB MATTRESS PATTING DEVICE

TECHNICAL FIELD

This invention relates to a crib mattress patting device, and more particularly to a multi-height adjustable crib mattress patting device.

BACKGROUND OF THE INVENTION

The prior art shows many devices that are used for imparting a vibration or pat to the mattress of an infant crib to soothe a baby or child and make them fall asleep. However, none of them are separate from the bed, mattress, or mattress grid itself.

Those concerned with these and other problems recognize the need for an improved crib mattress patting device that is adjustable to the height of the mattress as the baby grows from the newborn to the toddler age.

SUMMARY OF THE INVENTION

The present invention provides a device for imparting a pat to the underside of an infant crib for helping to soothe or induce sleep in a baby or child. The device includes a frame which sits on the floor beneath the crib. The frame includes a reciprocating means which is attached to the frame and a "T" bar structure which has a horizontal member with two ends that have apertures therein and a vertical member attached to the horizontal member midway between the two ends. A pair of elongated vertical rods are adjustably attached to each end of the horizontal member by wing nuts. Attached to the top of the vertical rod is a resilient cup-like structure that contacts the underside of mattress when the device is electrically connected to a power source.

An object of the present invention is the provision of an improved multi-height adjustable crib mattress patting device that can be adjusted to properly engage the underside of the mattress as the height of the mattress in the crib is adjusted.

Another object of the present invention is to provide a patting device that is free standing on the floor underneath the crib and is not attached to the mattress grid springs.

A further object of the invention is the provision of a patting device that is safe and efficient to use.

Still another object is to provide a patting device that is inexpensive to manufacture.

A still further object of the present invention is the provision of a patting device that is easy to set up and take down.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

DESCRIPTION OF THE PREFERRED EMBODIMENT

Figure 1:
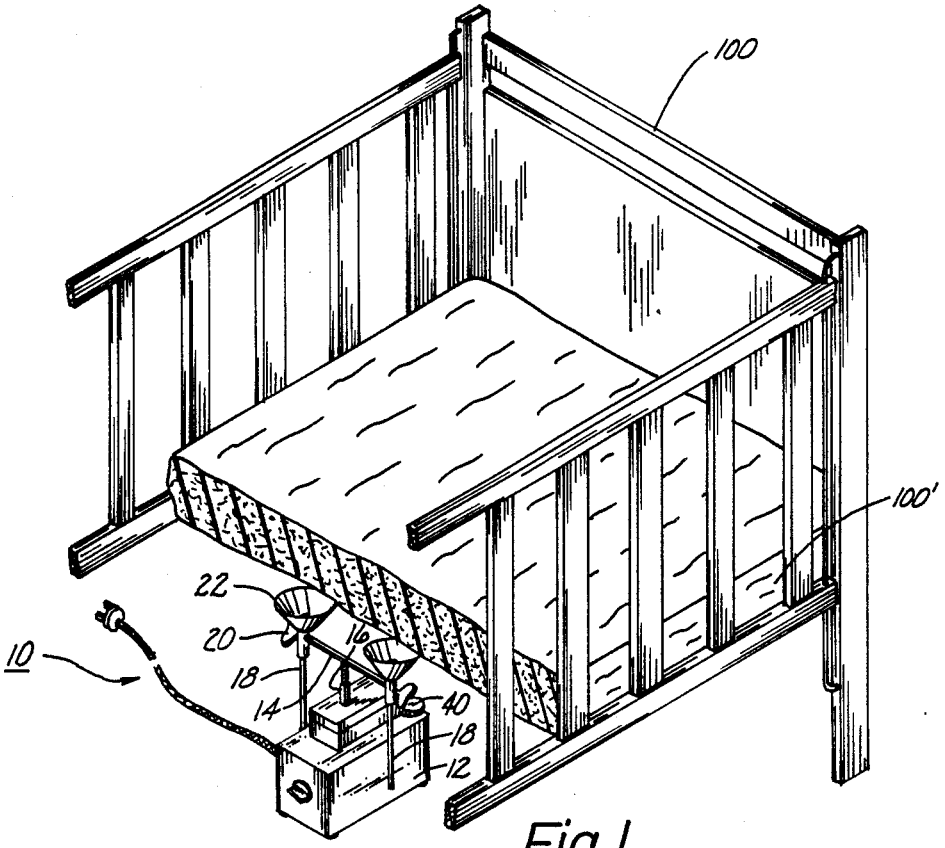
FIG. 1 is a perspective view of the crib mattress patting device of the present invention shown on the floor underneath a crib.

Referring now to the drawings, wherein like reference numerals designate identical or corresponding parts throughout the several views, FIG. 1 shows the device (10) sitting on a floor underneath a crib (100) and contacting the bottom side of a mattress (100').

Figure 2:
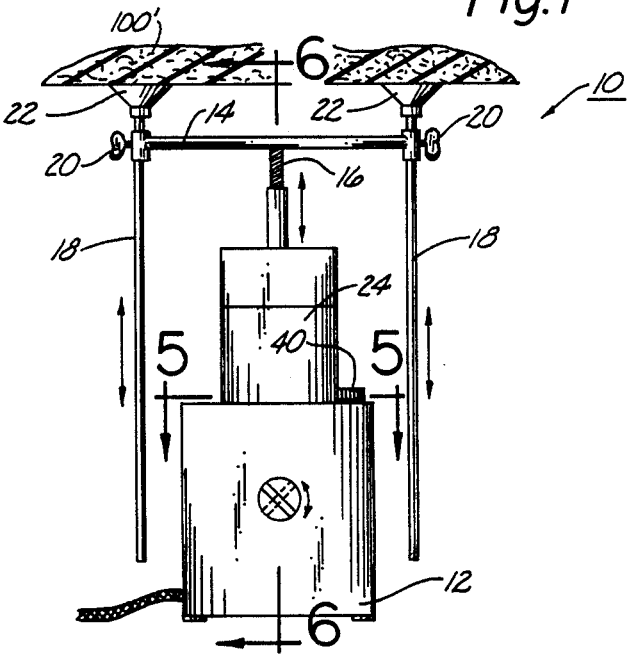
FIG. 2 is a side elevational view thereof with the arrows depicting the path of travel for the rods and members of the device.

Referring to FIGS. 1 and 2, the device (10) includes a frame (12), a "T" bar structure including a horizontal member (14) and a threaded vertical member (16) that is secured to the horizontal member (14) midway between the two ends of the horizontal member (14). A pair of vertically disposed rods (18) are slidably, adjustably attached to the member (14) at the ends thereof by wing nuts (20). A resilient cup-like structure (22) is mounted on the top end of the rod (18) to contact the underside of a crib mattress (100') when the device (10) is in use. A bracket (24) is secured to the top of the frame (12) for stabilization of the device (10), by means of screws, welding or the like.

Figure 3:
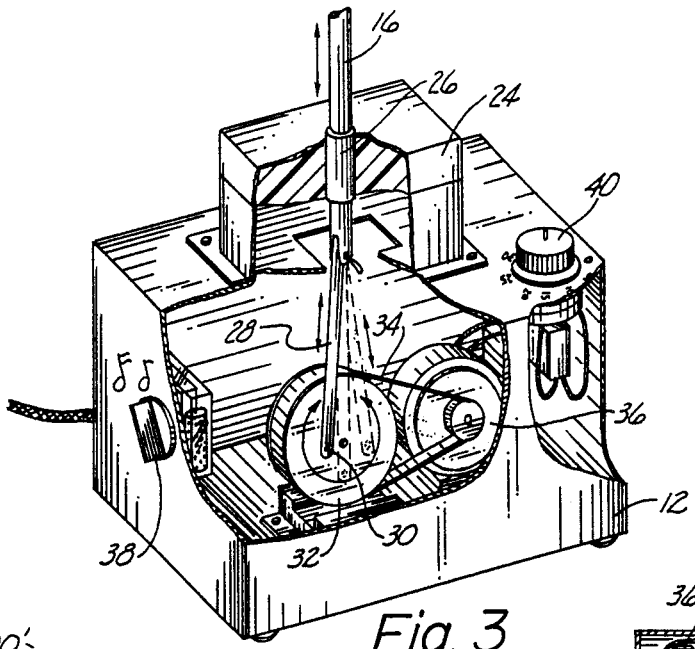
FIG. 3 is a cut-away perspective view showing the interior of the frame with the arrows depicting the rotation of the flywheel and direction of travel of the piston rod attached to the vertical member.
Figure 4:
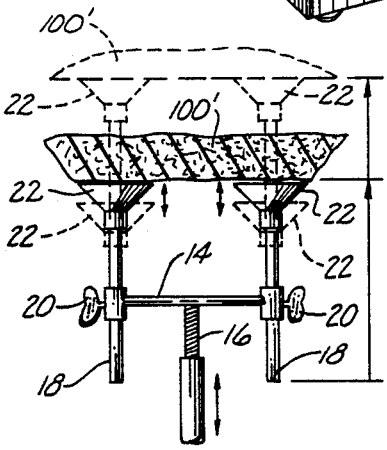
FIG. 4 is a side elevational view of the "T" bar structure and cup-like structure showing the adjustability of the device in relation to the bottom side of a mattress.
Figure 5:
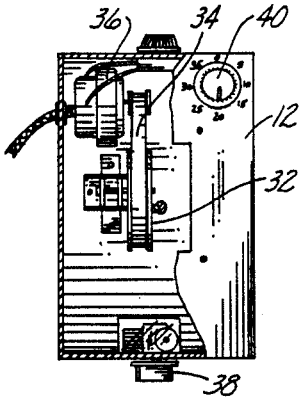
FIG. 5 is a top plan view of the frame taken along line 5—5 in FIG. 2.
Figure 6:
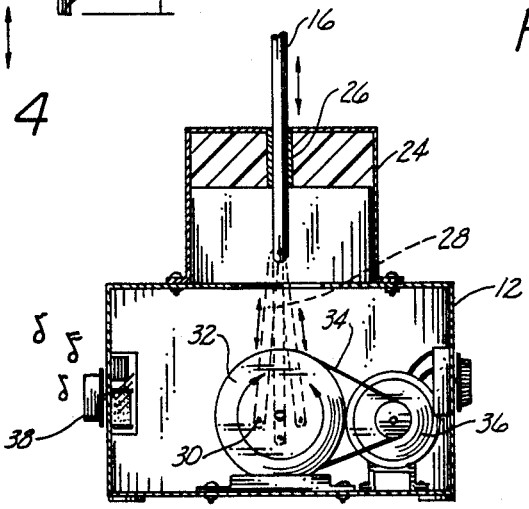
FIG. 6 is a side elevational view of the frame taken along line 6—6 of FIG. 2 with the arrows showing the rotation of the flywheel and the direction of travel of the piston and vertical member.

Referring now to FIGS. 3 and 6, the bracket (24) further includes a hollow channel (26) formed in the middle of the bracket (24) which slidably receives the vertical member (16). The hollow channel (26) acts to stabilize the device (10) and prevent the structure from toppling or wobbling when in operation.

Still referring to FIGS. 3 and 6, it can be seen that the vertical member (16) is pivotally attached, by means of a cotter-pin or the like, at its lower end to a piston (28) which is connected to an off-center projection (30) on the flywheel (32). The flywheel (32) is turned by a pulley (34) that is connected to the output shaft of an electric motor (36). A wind-up melodic mechanism (38) is included which will play music and help soothe and infant. A timer (40) is electrically connected to the motor (36) for selecting the length of time the device (10) will be in operation.

In use, an infant is placed in the crib. The mattress (100') of the baby crib (100) is adjusted to the proper position depending upon the age of the child. The mattress (100') would be placed at its uppermost position for a newborn, a lower position for an older baby and in its lowest position for a toddler-age child. The device (10) is placed under the crib (100) and connected to an appropriate power source. The wing nuts (20) are loosened and vertical rods (18) are adjusted so that the resilient cup-like structures (22) make contact with the underside of the crib (100) and mattress (100'). When the appropriate contact is made, the wing nuts (20) are then tightened to keep the cup-like structures (22) in place. The desired length of time of the patting to the mattress (100') is selected by the timer (40). If desired, activation of the melodic mechanism (38) is initiated. The device (10) will continue with a rhythmic pat to the underside of the crib mattress (100') until the timer (40) has run the appropriate sequence.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A device for imparting a pat to the underside of an infant crib for helping to soothe an infant or child, said device comprising:

a frame;

a reciprocating means attached to said frame;

a "T" bar structure including a horizontal member having two ends with apertures therein, and a threaded vertical member secured to said horizontal member midway between said two ends, said vertical member being secured to said reciprocating means for reciprocating said "T" bar structure;

a pair of elongated rods each having a top end and a bottom end, each of said elongated rods being adjustably vertically secured to an end of said horizontal member; and a resilient cup-like structure attached to said top end of each of said vertical members, said cup-like structures being disposed to contact the underside of the crib.

2. The device of claim 1 wherein said frame further includes a bracket disposed to slidably receive and stabilize said vertical member of said "T" bar structure.

3. The device of claim 2 wherein said bracket includes a hollow channel formed through the middle thereof, and disposed to slidably receive said vertical member.

4. The device of claim 1 wherein each of said elongated rods is adjustably attached to said "T" bar structure by wing nuts.

5. The device of claim 1 further including a wind-up melodic mechanism for playing music in conjunction with the patting.

6. The device of claim 1 wherein said reciprocating means, includes:

an electric motor;

an eccentric flywheel operable attached to said electric motor; and a piston attached to and interconnecting said flywheel and said vertical member of said "T" bar structure, said flywheel including an off-center projection for attachment to said piston.

7. The device of claim 6 further including a timer operably connected to said electric motor.

* * * * *